United States Patent [19]

Denlinger et al.

[11] Patent Number: 5,067,916

[45] Date of Patent: Nov. 26, 1991

[54] METHOD FOR MAKING AN ELECTRICAL CONTACT

[75] Inventors: Keith R. Denlinger, Lancaster; Richard W. Gryzbowski, Lebanon; John M. Myer, Millersville, all of Pa.

[73] Assignee: AMP Incorporated, Harrisburg, Pa.

[21] Appl. No.: 596,274

[22] Filed: Oct. 12, 1990

[51] Int. Cl.[5] ..... H01R 13/00

[52] U.S. Cl. ..... 439/857; 439/887; 29/885

[58] Field of Search ..... 439/857, 858, 861, 862, 439/886, 887; 29/885

[56] References Cited

U.S. PATENT DOCUMENTS 3,605,071 9/1971 Sedlacek ..... 439/402

4,776,651 10/1988 Paulo ..... 439/857

*Primary Examiner*—Joseph H. McGlynn

*Attorney, Agent, or Firm*—Allan B. Osborne

[57] ABSTRACT

A method of making electrical contacts (10) for either tin or gold-plating without changing the overall dimensional shape of the contact (10) has been disclosed. The method includes the step of providing a given spring rate for a pair of cantilever beams (26) by cutting the beam (26) to a predetermined width without changing the length thereof.

2 Claims, 4 Drawing Sheets

METHOD FOR MAKING AN ELECTRICAL CONTACT

FIELD OF THE INVENTION

The present invention relates to a method for making receptacle contacts where the spring rate can be varied without changing the overall dimensional shape of the contact.

BACKGROUND OF THE INVENTION

Receptacle contacts having cantilever beams for receiving cylindrical pins are well known in the art. U.S. Pat. No. 4,776,651 discloses one such contact. However, prior art receptacle contacts have predetermined spring rates for a specific plating; i.e., a tin plating required a higher normal force than does a gold plating. Obviously prior art receptacle contacts designed for one spring rate had different overall dimensions than a contact designed for another spring rate where the material thickness is constant. This then sometimes necessitated different connector housings. Accordingly, it is now proposed to provide a method for making a receptacle contact where the spring rate can be changed without changing the overall dimensional envelope of the contact.

SUMMARY OF THE INVENTION

According to the invention a method of making contacts for either gold or tin plating without changing the overall dimensional shape includes the step of varying the width of the cantilever beams to obtain the desired spring rate without changes to the length thereof.

DESCRIPTION OF THE INVENTION

Figure 1:
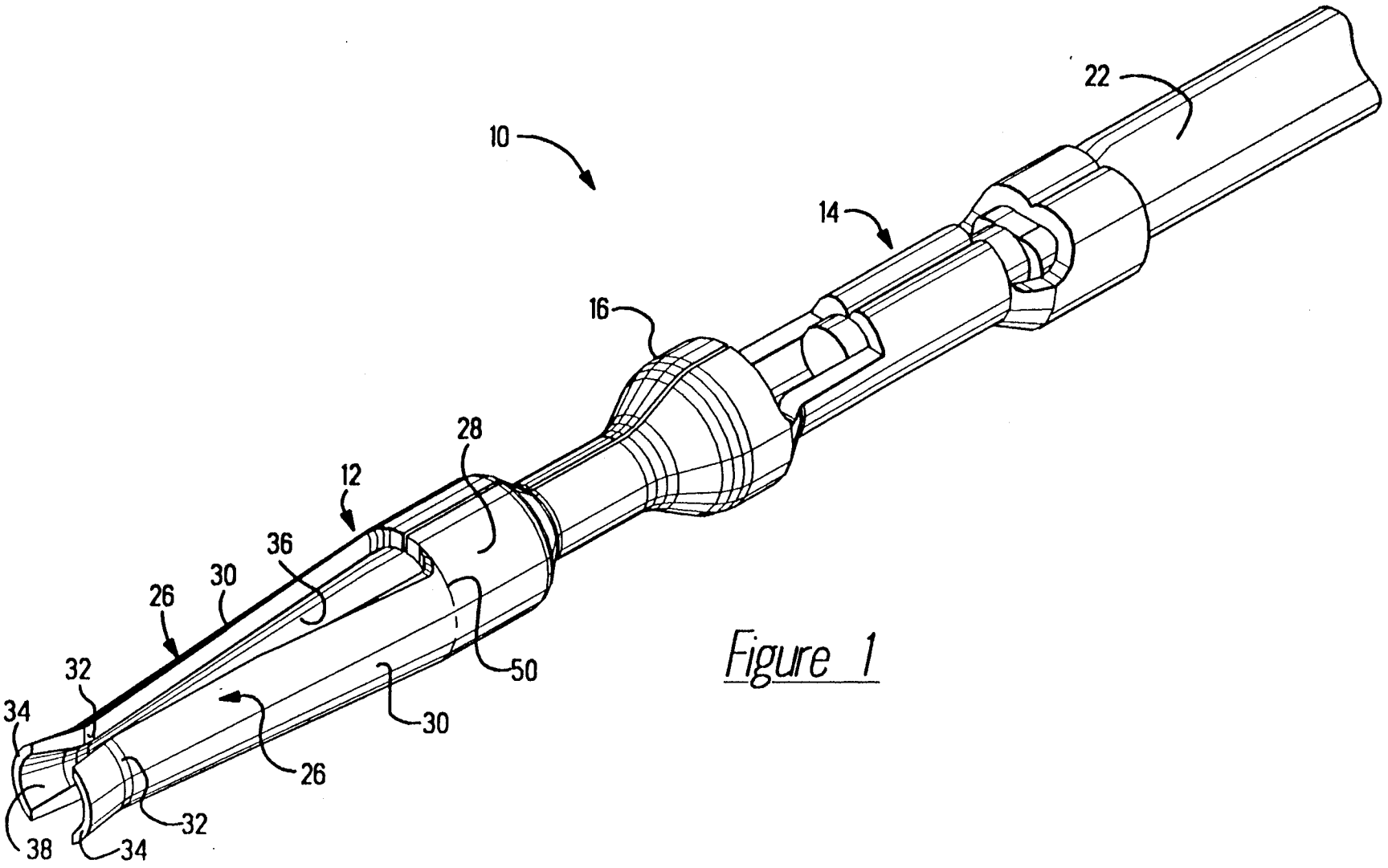
FIG. 1 is a perspective view of a receptacle contact of the present invention.

The receptacle contact 10 shown in the several drawings; e.g., FIG. 1 to which reference is now made, includes a receptacle section 12, wire connection section 14 and an intermediate section 16.

Wire connection section 14 includes a wire crimping ferrule 18 and insulation crimping ferrule 20. Other wire attaching means may be used; e.g., wire barrels, solder tails and so forth. Wire 22 is shown in FIG. 1 terminated to receptacle 10 by crimping.

Intermediate section 16 includes retention and positioning features (not referenced) and obviously connects sections 12 and 14.

Receptacle section 12 includes a pair of cantilever beams 26 which are attached to an extend outwardly from opposite sides of cylindrical base 28.

Beams 26 are identical and can be subdivided into leg portions 30, pin contact surface 32 and tips 34. Overall the beams 26 have an arcuate shape from edge to edge which reflects the radius of base 28. This shape provides an interior concave surface 36 to conformably receive a cylindrical pin (not shown).

Leg portions 30 taper or converge relative to each other as they extend outwardly from base 28. The convergence terminates at surface 32 so that opposing surfaces 32 are parallel to a center line extending longitudinally through the receptacle section 12. Outwardly from surfaces 32, tips 34 diverge relative to each other to form a flared opening 38.

Figure 2:
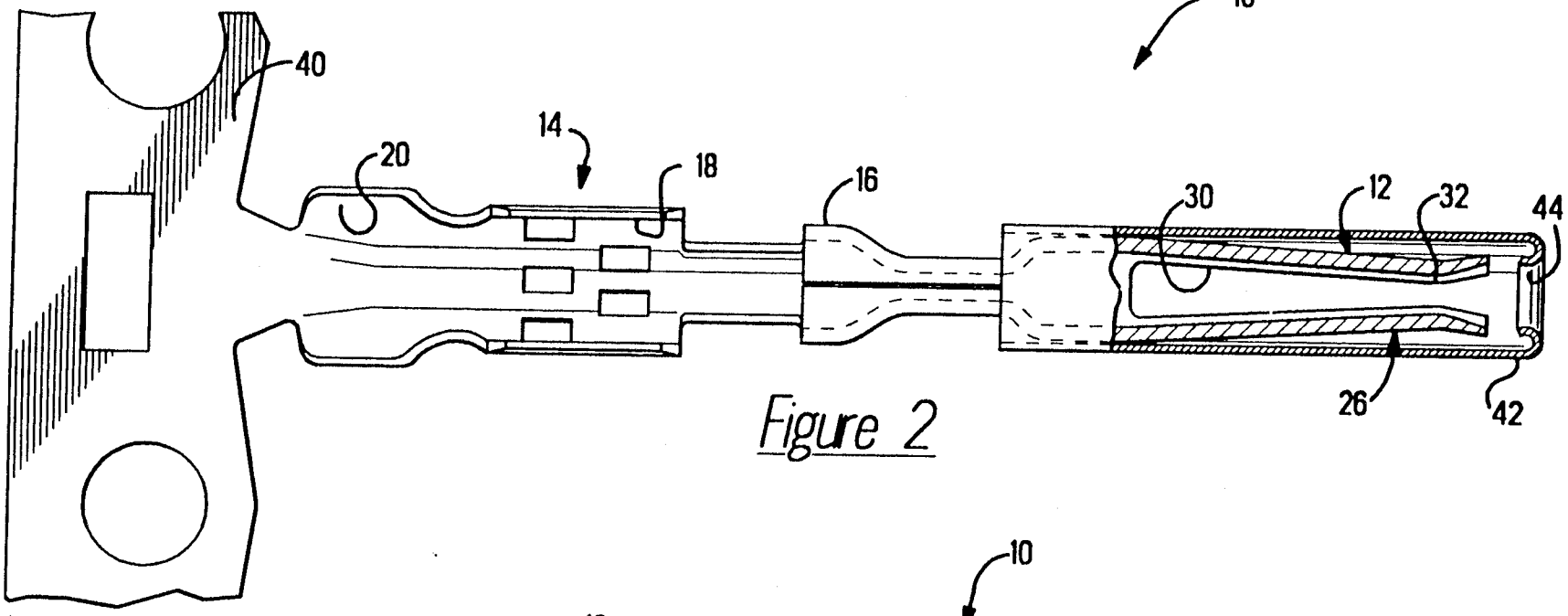
FIGS. 2 and 3 are top and side views respectively of the contact.
Figure 3:
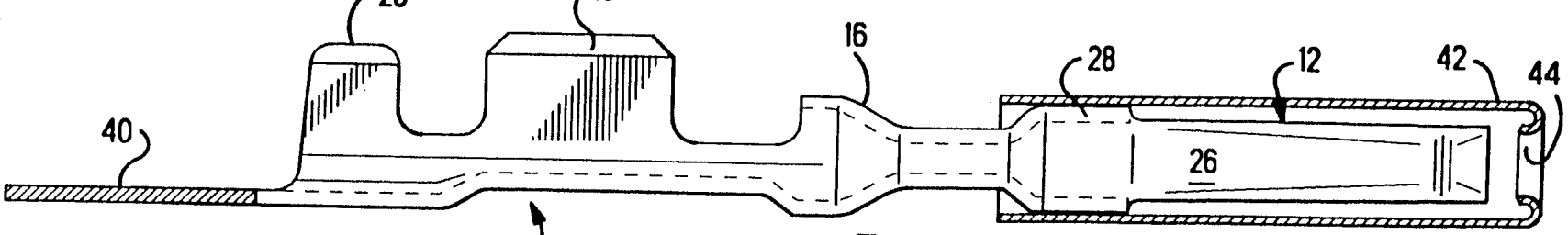
Figure 4:
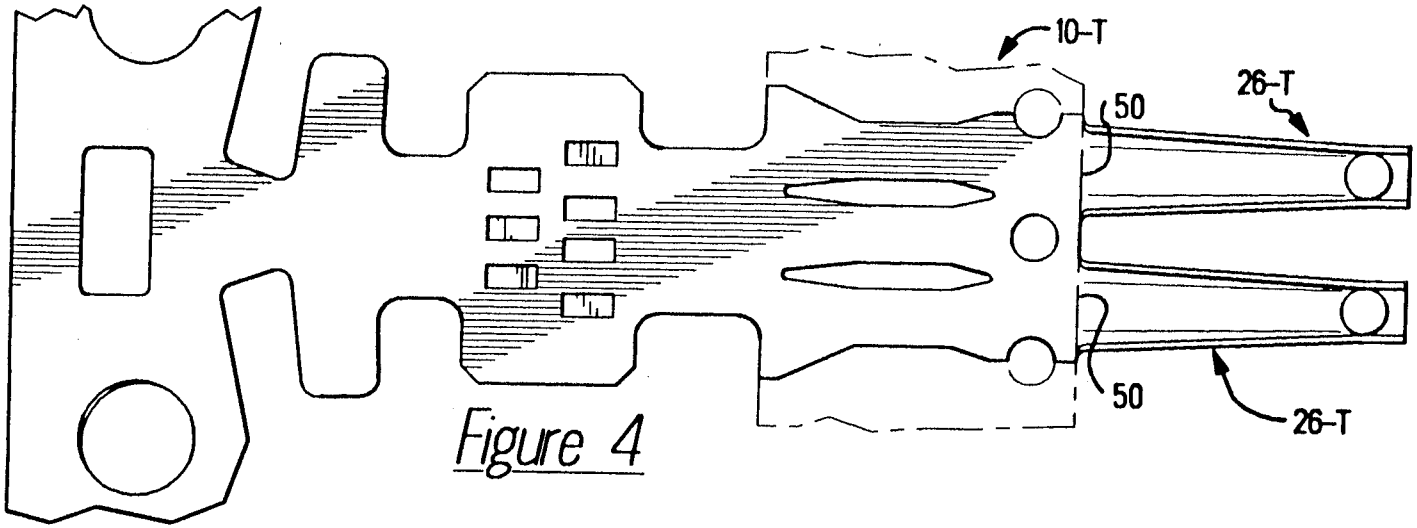
FIGS. 4 and 5 are plan views of the blanked-outline of the contact.
Figure 5:
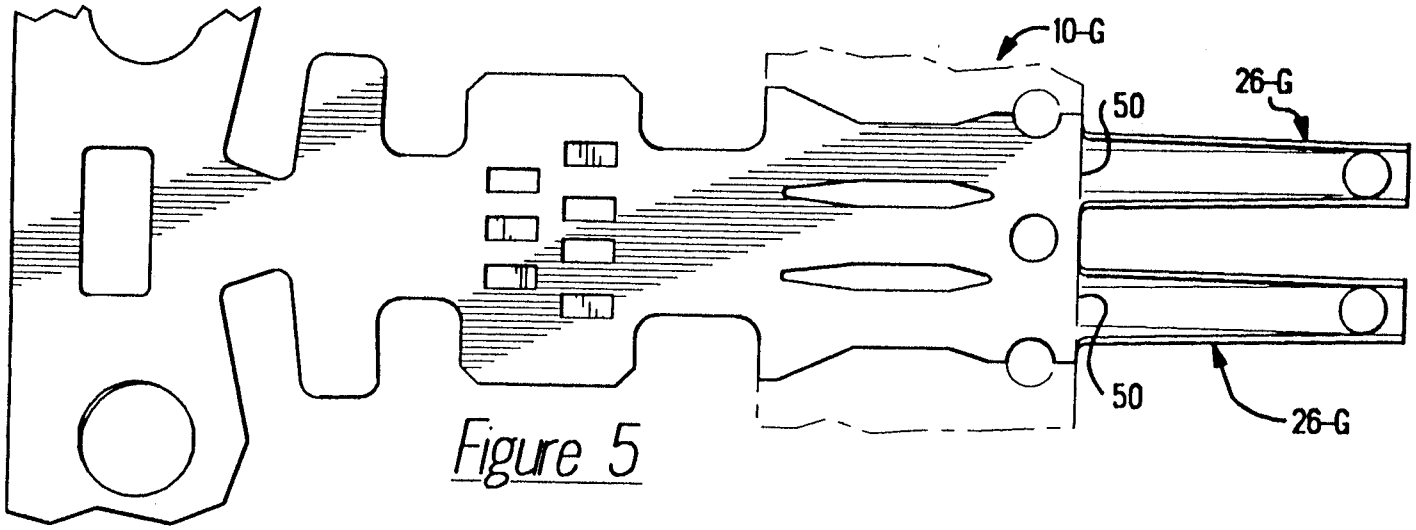
Figure 6:
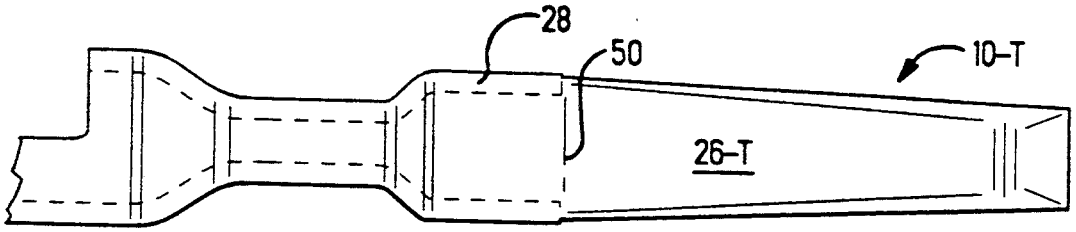
FIGS. 6 and 7 are side views of the contacts formed from the outlines shown in FIGS. 4 and 5 respectively.
Figure 7:
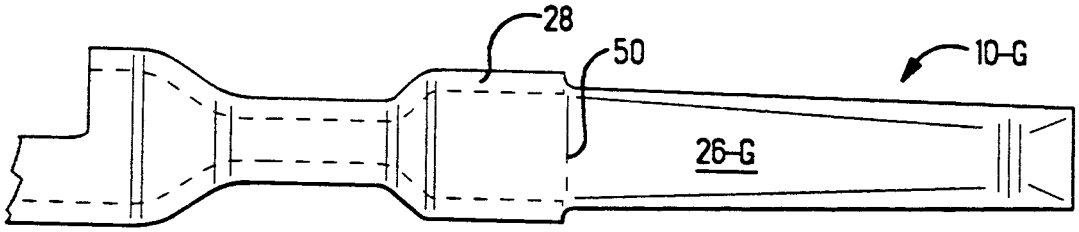

FIGS. 2 and 3 show receptacle contact 10 prior to wire 22 being attached thereto and still on carrier strip 40 as is the common practice in stamping and forming operations. Also shown is sleeve 42 which fits over receptacle section 12 to protect beams 26 from damage and to aid in guiding a pin (not shown) into section 12 via opening 44.

As is known in the art a pair of cantilever beams 26 that have a tin-plated interior surface 36, at least on pin contact surfaces 32, are required to press in on a pin (not shown) inserted into section 12 with a high normal force. Conversely a gold-plated surface 36 and surface 32 allows the beams 26 to press in with a lower normal force without a decrease in electrical conductivity. Further, it is the practice in the art to reduce the beams normal force capacity by increasing their length for more resiliency or to make them shorter to make them stiffer. This of course makes the contacts of unequal overall dimensions and accordingly requires different cavity sizes (not shown) in the connector housing (not shown).

The present invention avoids this problem by changing the included angle of the arc of beams 26, i.e., for a tin-plated contact 10, the included angle of the arc of beams 26-T at the juncture with base 28 is greater than the included angle of the arc of beams 26-G for a gold-plated contact 10 by ten percent. Thus, for a gold-plated contact 10 having an arc of 100 degrees, a tin-plated contact 10 would have an arc of 110 degrees. The location for the measurement of the included angle of the arc is indicated by dashed line 50 in FIG. 1. The additional material increases the spring rate to provide a higher normal force.

Significantly, the included angle of the arc taken at pin contact surface 32 remains the same for both gold-plated and tin-plated contacts 10. This arc, in the 100 degree—110 degree example, is eighty degrees.

The method used to blank out a contact 10 for either gold or tin plating is by changing out the punch in work station die so that the desired width can be obtained while beams 26 are still flat. The greater width of beams 26-T can be seen in the comparison FIGS. 4, 5, 6 and 7 wherein the letters "T" and "G" following a reference numeral; e.g., 10-T, indicates a tin or gold contact.

Additionally, the normal force can be increased by pre-loading beams 26 so that the space or gap, between opposing pin-contact surfaces 32 in a tin-plated contact 10 is less relative to that space in a gold-plated contact 10.

Figure 8:
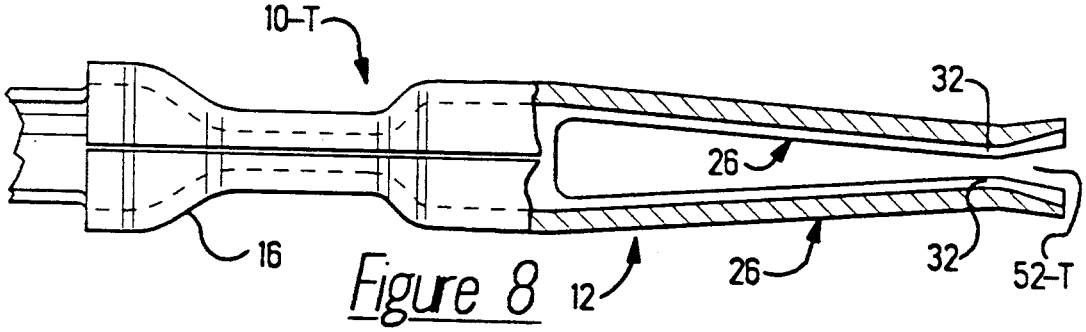
FIGS. 8 and 9 are top views of the contacts shown in FIGS. 6 and 7 respectively.
Figure 9:
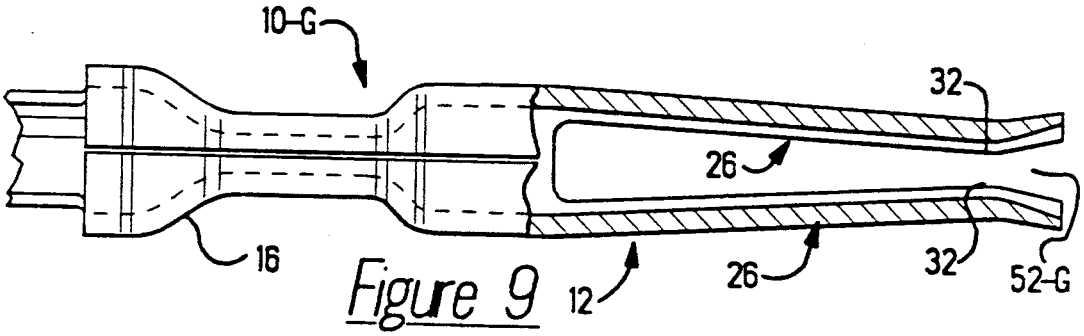

FIGS. 8 and 9 illustrate the gaps, indicated by reference numerals 52-G and 52-T respectively, for contacts 10-T and 10-G respectively.

The gap is achieved by pre-loading beams 26 as required.

As can be discussed from the foregoing description, a method of making an electrical contact has been disclosed wherein the spring rate of the cantilever beams may be changed during the stamping and forming of the contact without changing the overall dimensional envelope. This capability is achieved by blanking out the beams' width to that required to provide the desired spring rate.

We claim:

1. A method of making an electrical socket contact for either gold plating or tin plating without changing the length of the socket contact, said method comprising the steps of:

blanking out of contact outline comprising a wire barrel at one end and a pair of parallel beams at another end and varying the width of said beams to produce either a high spring rate for tin plating or a low spring rate for gold plating without a change in the length of said beams; and rolling said contact outline into a cylindrical form with said beams defining a socket for receiving a pin.

2. An electrical socket contact produced by the method of claim 1.

* * * * *